United States Patent [19]

Wilson

[11] 4,361,917

[45] Dec. 7, 1982

[54] PORTABLE ORTHOPEDIC BED

[76] Inventor: Harold L. Wilson, Rte. 2, Box 78C, Pevely, Mo. 63070

[21] Appl. No.: 136,803

[22] Filed: Apr. 3, 1980

[51] Int. Cl.[3] ..... A61G 7/00; A61G 7/06

[52] U.S. Cl. ..... 5/68; 5/69

[58] Field of Search ..... 5/66–68, 5/69

[56] References Cited

U.S. PATENT DOCUMENTS

| | | | |
|---|---|---|---|
| 2,500,742 | 3/1950 | Taylor | 5/66 |
| 2,517,466 | 8/1950 | Cox | 5/66 |
| 2,631,300 | 3/1953 | Murray | 5/66 |
| 2,996,732 | 8/1961 | Drafer | 5/68 |
| 3,127,619 | 4/1964 | Bronstien | 5/68 |
| 3,245,092 | 4/1966 | Kreuz | 5/68 |
| 3,447,170 | 6/1969 | Spitz | 5/68 |
| 3,503,082 | 3/1970 | Kerwit | 5/68 |
| 3,593,350 | 7/1971 | Knight | 5/66 |
| 3,636,573 | 1/1972 | Bartz | 5/69 |
| 3,644,946 | 2/1972 | Swatt | 5/68 |

*Primary Examiner*—Alexander Grosz

*Attorney, Agent, or Firm*—Glenn K. Robbins

[57] ABSTRACT

A portable orthopedic bed which is formed as a super structure for conventional existing beds and may be switched from one such bed to another. The portable orthopedic bed is comprised of a flat semi-rigid planar base which supports an adjustable frame which may be raised and lowered in the fashion of an adjustable hospital bed. The frame is provided with wheeled supports for adjusting the tilt or inclination of a back rest portion and a leg portion by means of separate motors and worm gears. Appropriate controls are provided to activate the motors for raising and lowering the back and leg portions of the frame. The portable orthopedic bed through its rigid planar support may be lifted and placed upon a box spring or other frame of a conventional bed with the mattress being removed. After the portable bed frame is placed on the conventional bed the mattress may be placed over the orthopedic bed frame. The patient or other user may then use the bed in a conventional fashion for adjusting the back or leg portions as desired.

Through the rigid planar support the portable orthopedic bed may be placed upon the bed frame or its super structure such as a coiled box spring without obtrusion, snagging or the like and may be moved from one conventional bed to another, or even as desired placed upon the floor or any other flat support base.

5 Claims, 12 Drawing Figures

PORTABLE ORTHOPEDIC BED

BACKGROUND OF THE INVENTION

In the past various types of hospital or orthopedic beds of one type or another have been used. Such beds are employed in hospitals, sanitariums or the like and are generally of integral construction and are motorized or otherwise powered to provide for raising and lowering a back portion and lower leg portion of the bed.

Such beds as have been proposed and that have been in use in the past are generally of complicated and expensive construction suitable for use on a permanent basis in the hospital, sanitarium or other type of institutional use. Because of the expense and weight, such beds are generally not available for use in a home or for domestic applications.

By means of this invention there has been provided a portable orthopedic bed which may have adjustable inclined back rest and leg rest and which can be operated by the operator and may be transferred from a conventional bed of one type or another to another such bed with a minimum of time and labor. The bed is comprised of a flat semi-rigid planar base to which are supported mechanisms for permitting sliding and inclining adjustment of a back rest and leg rest.

The operator may adjust through conventional instrumentation the back rest and leg rest by separate motors working through worm gears to raise and lower the back rest and leg rest as desired.

The portable orthopedic bed of this invention is relatively simple in construction and through the planar base can be simply placed upon a conventional box spring or frame work of a conventional bed without difficulty and without snagging. As desired the orthopedic portable bed may be simply lifted and placed upon the floor or other flat base since it is comprised of all the necessary frame work to support the mattress which may be placed thereover.

By means of this invention, there has accordingly been provided a portable orthopedic bed which may be simply moved from one conventional bed to another as desired. The device may be used in the home at a modest cost by invalids, convalescents and anyone else desiring the advantages of a power operated adjustable bed.

The above features are objects of this invention and further objects will appear in the detailed description which follows and will be otherwise apparent to those skilled in the art.

For the purpose of illustration of this invention there is shown in the accompanying drawing a preferred embodiment thereof. It is to be realized that the drawings are for the purpose of example only and that the invention is not limited thereto.

IN THE DRAWINGS

DESCRIPTION OF THE INVENTION

Figure 1:
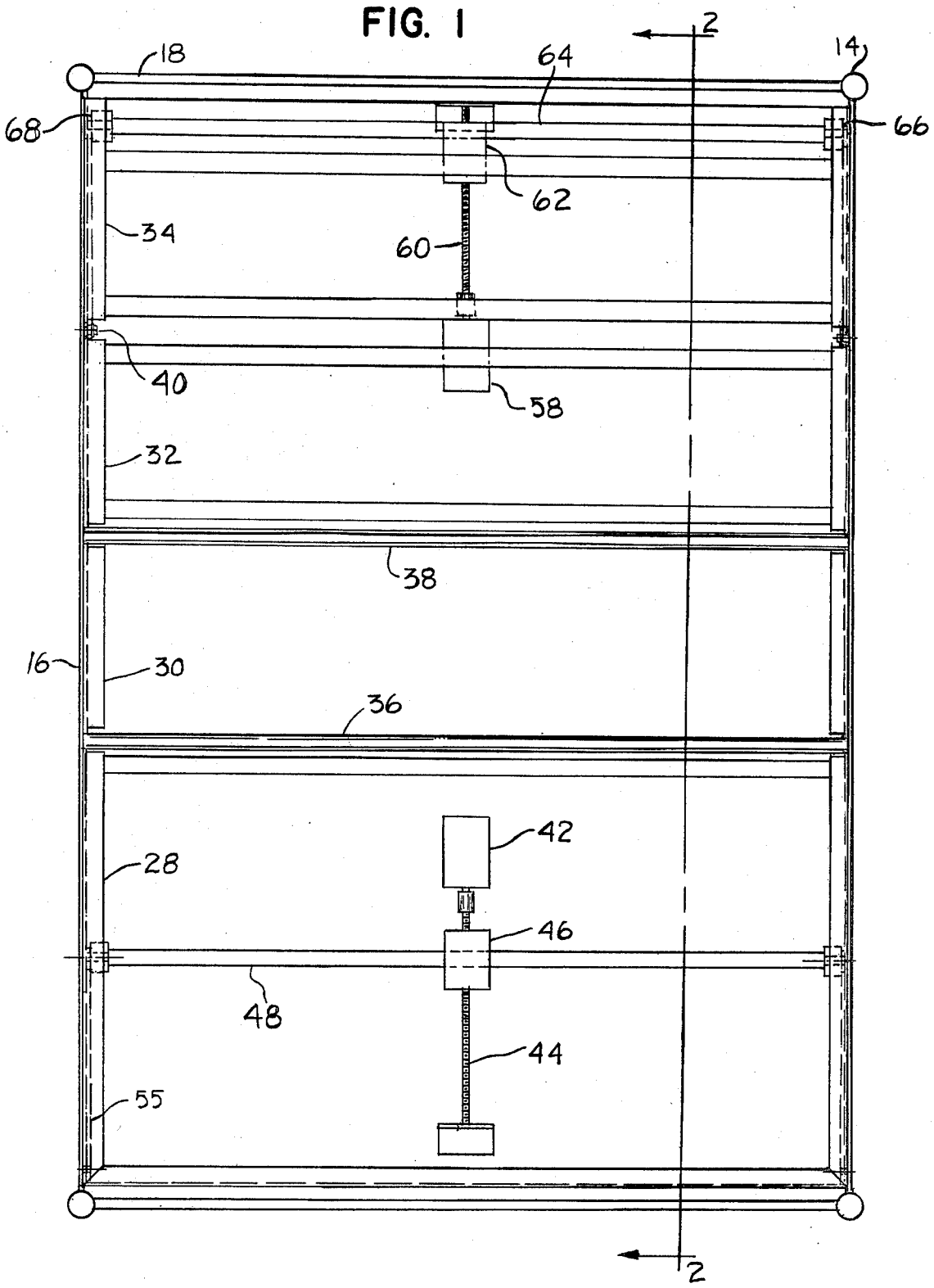
FIG. 1 is a top plan view of the portable inclining bed in the horizontal position.

The portable orthopedic bed of this invention is generally identified by the reference numeral 10. It is shown supported in FIG. 2, on a conventional bed 12, having upright posts 14 connected by longitudinal braces 16 and conventional cross braces 18 extending laterally between the posts.

The aforementioned lateral braces and longitudinal braces or stringers support a conventional box spring 20 which rests on slats 21 in the usual fashion.

The box spring simply rests in conventional fashion on the lateral and longitudinal stringers and it will be understood that additional lateral stringers or braces may be provided as in the conventional bed structures which, per se, form no part of this invention.

The portable orthopedic bed of this invention is generally shown by the reference numeral 10 and is comprised of a flat support base 24 and a tiltable and adjustable bed portion 26. The flat base 24 may be made of sheet metal, plywood, semi-rigid plastic or other conventional material of construction. It will also be understood that a frame comprising longitudinal and lateral brace members may likewise be used where the members are relatively closed spaced such that the frame can be simply placed over a box spring without snagging. Likewise, there may also be provided a screen or other perforate base to prevent snagging. The aforementioned flat base and tiltable bed which is connected thereto as will be more fully described, makes possible a portable orthopedic bed that may be placed upon a conventional bed and moved as desired from one bed to another.

The tiltable portion of the orthopedic bed supporting bed portion 26 is comprised of a tiltable back rest 28, a main body portion or hip supporting portion 30, and upper and lower leg support portions 32 and 34, respectively. All of these portions are comprised of frame members having pieces to support a mattress as will further appear.

In order to support the various frame portions of the bed support shafts 36, 38 and 40 are provided. The shaft 36 supports the back rest portion 28 for pivotal movement, shaft 38 supports the upper leg portion 32 for pivotal movement and shaft 40 inter-connects the upper and lower leg portions 32 and 34 for pivotal movement.

In order to provide for raising and lowering adjustment of the upper body and back portion of the bed 28 and the leg portions 32 and 34, worm gear and reversing motor moving mechanisms are provided. Motor 42 and rotary worm gear 44 furnish power for the back rest. A threaded block 46 receives the worm gear 44 and is connected to a shaft 48 which serves to support rollers 50 and 52. These rollers use the base 24 as a track with side walls 55 serving as a guide. By means of links 54 pivotally connected by a pivot 56 to the lower side of the back rest 28 at one end and to the rollers at the other end the back rest is raised or lowered as the motorized worm gear is rotated in one direction or a reverse direction. The direction of rotation is determined by the operator by a conventional switching mechanism and control mechanism to be described hereinbelow.

Figure 2:
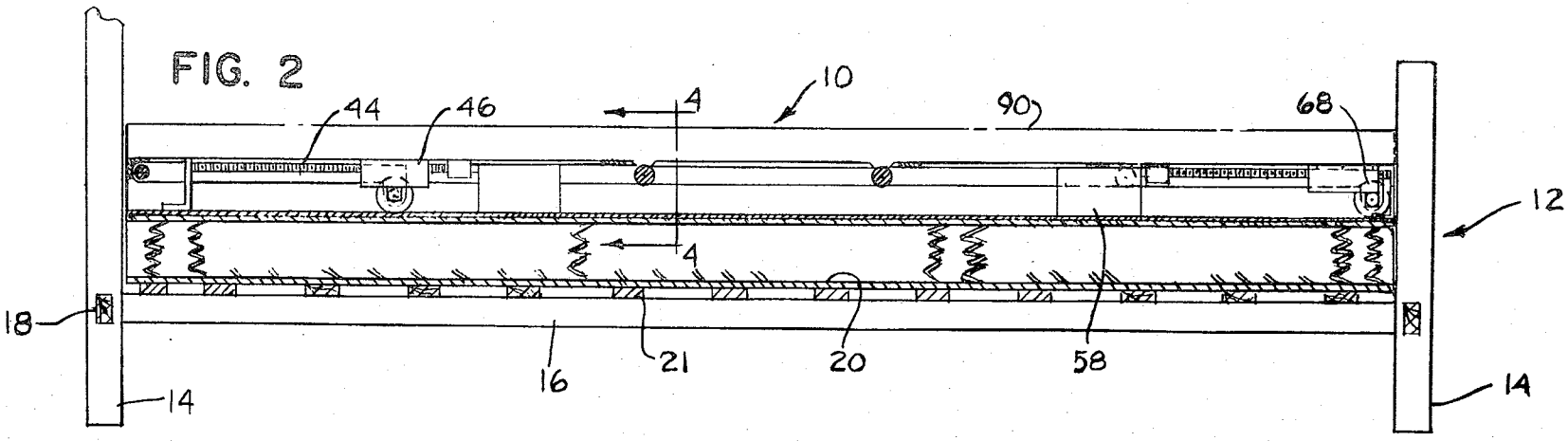
FIG. 2, is a view in section taken on the line of 2—2 of FIG. 1.

The motor 58 is used to raise and lower and adjust the upper and lower leg portions of the bed, 32 and 34. It is connected to a worm gear 60 which is received within a threaded block 62 connected by a cross shaft 64 which serves as an axle for rollers 66 and 68. These rollers roll upon the orthopedic bed base in a similar fashion as described for rollers 50 and 52. As the rollers are moved the leg portions 32 and 34 may be pivoted from the elevated position shown in FIG. 3, to the flat or rest position as shown in FIG. 2.

Figure 3:
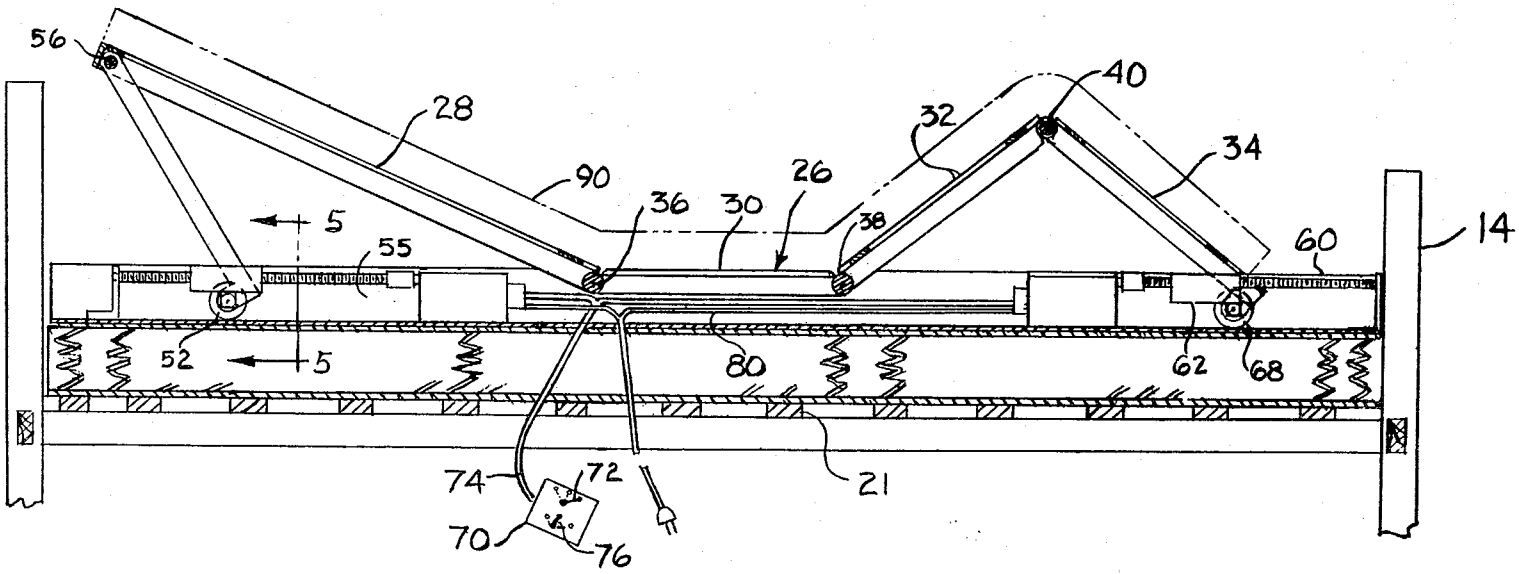
FIG. 3, is a view in section taken similarly to FIG. 2, but showing the bed in a slightly raised position.
Figure 4:
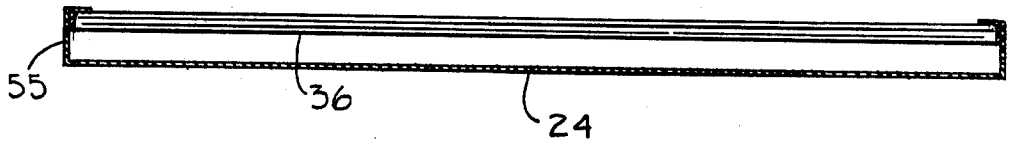
FIG. 4, is a view in section taken on 4—4 of FIG. 2.
Figure 5:
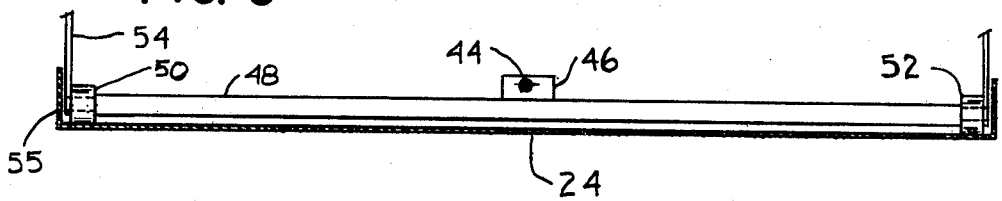
FIG. 5, is a view in section taken on the line 5—5 of FIG. 3.
Figure 6:
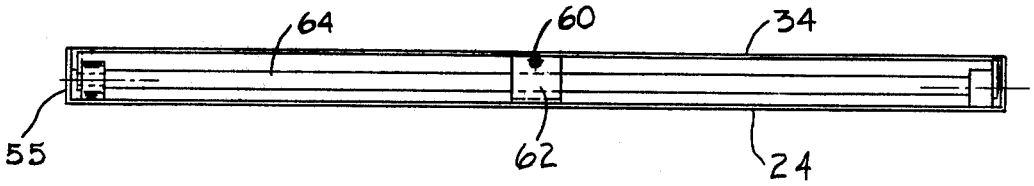
FIG. 6, is a view in elevation taken of the right end of FIG. 2 and the bottom of the bed.
Figure 7:
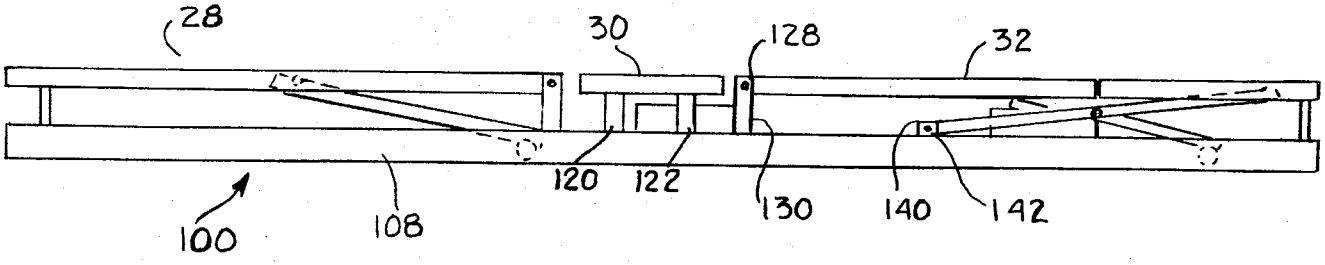
FIG. 7, is a view in side elevation of a modification of the bed.
Figure 10:
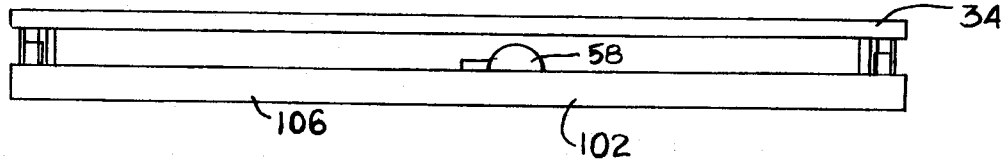
FIG. 10, is a view in end elevation taken from the foot end of the bed.
Figure 11:
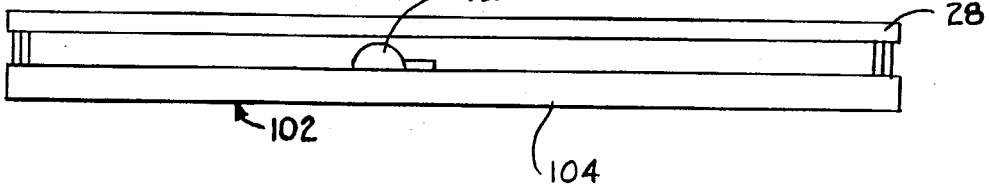
FIG. 11, is a view in end elevation taken from the head end of the bed.
Figure 8:
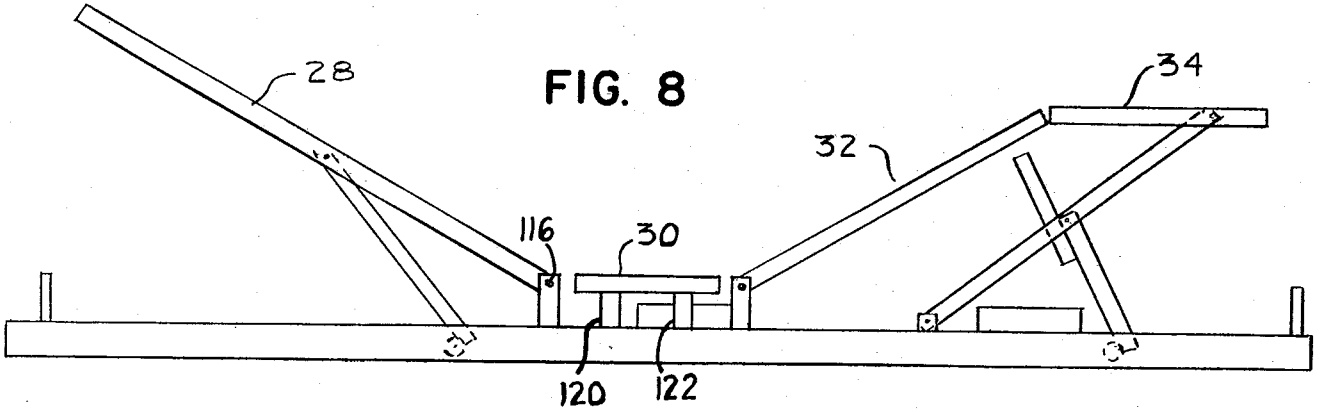
FIG. 8, is a view taken similarly to FIG. 7 but showing the bed in an elevated position.

In order to provide electrical control for the motors 42 and 58 to raise and lower the back rest and the leg portions respectively, a control panel 70 is provided. This panel has the top toggle switch 72 connected by a lead 74 to the motor 42. The switch is moveable from a central "off" position to the solid line "raise" position to raise the back rest to the position as shown in FIG. 3 and is moveable to the dotted line "lower" position to reverse the direction of the motor to lower the back rest to the flat horizontal position as shown in FIG. 2. Likewise, a switch 76 is provided which is connected by electrical lead 80 to the motor 58 for operating the leg portions 32 and 34 of the bed 26. In the "raise" position shown in full lines, the leg rest is raised to the position shown in FIG. 3, while the "lower" position shown in dotted lines is employed to reverse the direction of the motor to lower the leg rest to the horizontal position shown in FIG. 2. Such instrumentation is conventional and forms no part of this invention, per, se, as will be readily understood by those skilled in the art.

A modified form of the bed is generally designated by the reference numeral 100 in FIGS. 7 through 12. This bed likewise uses a semi-rigid planar base and motorized worm gearing and tiltable back rest and foot portions and instrumentation similarly to the embodiment of FIGS. 1 through 6 and similar elements will be given the same reference numerals.

The bed 100 is comprised of a frame-like base 102 of inter-connected angle irons 104 and 106 at the foot end and head end respectively and similarly constructed side rails 108 and 110 which support and guide rollers. Cross braces 112 and 114 provide additional strengthening, rigidity and support for the base 102 and further serve to support a head support motor 46 and foot support motor 58.

The modified bed is provided with a tiltable head and back support 28, an intermediate body and hip support 30 and lower leg supports 32 and 34 which are spaced five inches or so above the base to provide clearance for the motors and gearing.

The back support is pivoted at a pivot 116 to vertical braces 118 at its lower end. At its upper end it is pivoted by a pair of links 54 which are connected at their other end to a shaft 48 which serves to support rollers 50 and 52. The rollers ride and are guided by the angle iron side rails 108 and 110. The shaft 48 is connected to threaded block 46 which receives the worm gear 44.

The hip support 30 is comprised of a pair of vertical supports 120 and 122 at each side of the bed frame which support cross braces 124 and 126.

The lower leg supports 32 and 34 are pivotally connected to the base by a pivot connection 128 at vertical braces 130. The supports 32 and 34 are hingedly connected together by hinges 132 and 134.

In order to raise and lower the leg supports 32 and 34 and to support the lower leg support above the base a pair of links 136 are pivotally connected by a pivot connection 138 to the lower leg support at one end to a vertical support 140 by a pivotal connection 142 at an opposite end.

Figure 12:
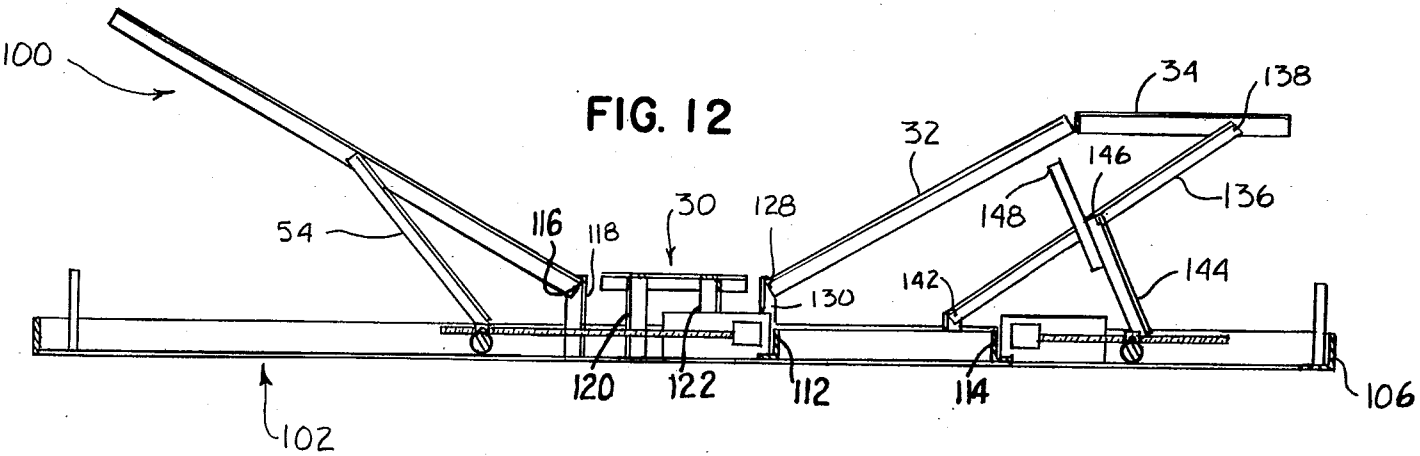
FIG. 12, is a view in vertical section taken on the line 12—12 of FIG. 9, but with the bed elevated.
Figure 9:
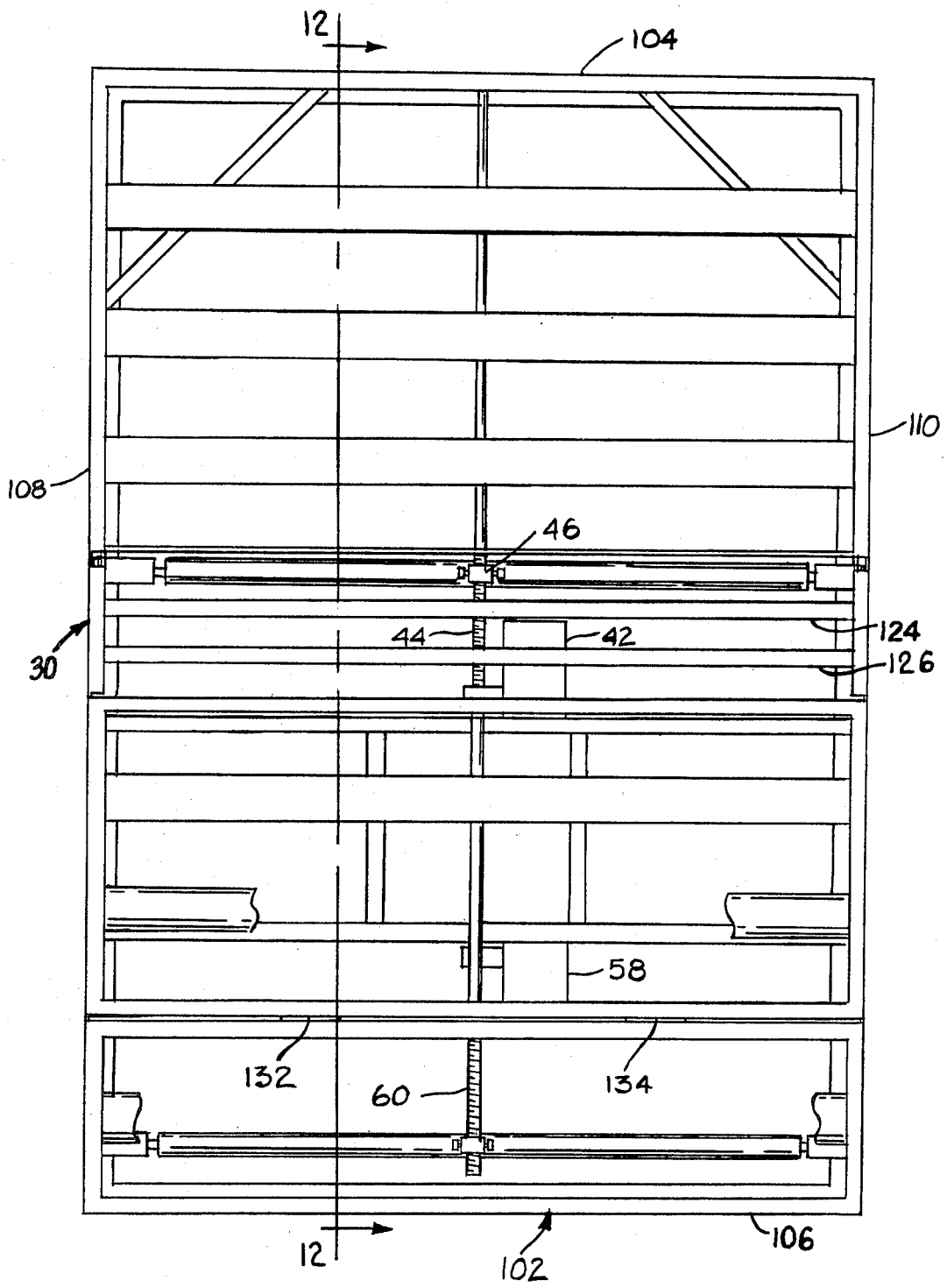
FIG. 9, is a top plan view of the modification.

The links are raised and lowered by a pair of power links 144 which are pivotably connected by a pivot connection 146 to the links 136 at an intermediate portion as shown in FIG. 12 and are pivotably connected to a shaft 64 at their lower end which serves as an axle for rollers 66 and 68. The shaft 64 is connected to the threaded block which receives the worm gear powered by the motor 58.

The power link has a free end 148 which in the lower most positions of the lower leg supports 32 and 34 bears against the underside of the leg support 32 and serves in load bearing relation to raise and lower the leg support to relieve the strain upon the links 136 and 144. In the uppermost positions the free end is separated as shown in FIG. 12 as the link 144 assumes a posture of vertical thrust against link 136.

The instrumentation for the back and head rest motor 42 and for the leg rest motor 58 is indentical with that described for the embodiment 10 in FIGS. 1 through 6 and is not shown.

USE:

The orthopedic bed of this invention is simply collapsible to the flat horizontal position shown in FIG. 2 in order that it may be moved from one bed to another or placed upon any flat support for use as desired. The frames constituting the various portions of the bed portion 26 support a conventional mattress 90 which may be simply laid over the bed frames. The bed is then ready for use.

The user to raise the back rest portion of the bed 28 simply moves the switch 72 in the control panel to the "raise" direction as shown in the full bodied lines which causes the motor to turn the worm gear and move the gear block to elevate the back rest. To reverse the direction of the movement, and to lower the bed, control switch 72 is moved to the left "lower" position shown in the dotted lines which causes the reverse movement of the worm gear to move the gear block towards the end of the bed to lower the back rest as desired.

Likewise, to raise the leg rest portions 32 and 34 of the bed the switch 76 is operated. For such elevation the switch is moved to the right or toward the "raise" direction shown in full bodied lines which causes the motor 58 to turn the worm gear and move the gear block to the left as viewed in FIG. 3, or towards the head of the bed. The switch is operated until the desired positioning is effected.

In order to lower the leg portions of the bed the direction of the switch 76 is reversed to the left and to the "lower" direction shown in dotted lines. This causes the reversal of the motor 58 and the worm gear to cause the gear block 62 to move towards the foot of the bed or the right of the bed as shown in FIG. 3 until the desired lowered position is achieved.

The modified bed 100 of FIGS. 7 through 12 is operated through the control panel 70 in an identical fashion to the operation of bed 10 in FIGS. 1 through 6. Thus switch 72 is utilized to raise and lower the head and back rest portion 28 through motor 42 while the switch 76 is utilized to raise and lower the upper and lower leg rest supports 32 and 34 through motor 58.

The leg supports 32 and 34 while being raised and lowered assume different positions in the modified bed as the lower end of the lower leg support is elevated with respect to the bed frame rather than remaining lowered as in the bed embodiment 10 in FIGS. 1 through 6.

The scissors shaped linkage provided by the links 136 and 134 provide an efficient structure for raising and lowering the lower leg support and relieving the stress and strain upon the links as the load relationship is varied.

The orthopedic bed of this invention can be simply employed by various types of users whether they be infirm, recuperating from various types of surgery, or hospitalization or for any desired use of the user. The ease in manipulation is such that the operator can raise and lower the back rest to any position as desired without effort or complications.

Through the light weight and simple construction of the orthopedic bed the use can be simply effected in a wide variety of applications. The bed may be placed upon any conventional beds whether they be the bare bed frame or a box spring with or without the mattress being removed. In fact the orthopedic bed may be simply placed on existing mattresses then covered by another mattress as desired and a full range of adaptability has been made possible.

Various changes and modifications may be made within this invention as will be readily apparent to those skilled in the art. Such changes and modifications are within the scope and teaching of this invention as defined by the claims appended hereto.

What is claimed is:

1. A portable orthopedic bed comprising a flat base, a frame-like back rest, an intermediate body rest and a leg rest, said back rest being pivotably supported at one end above said base toward said body rest and said leg rest being pivotably supported at one end toward said body rest, said aforementioned rests being supported upon said flat base and separate motor means supported upon said flat base for pivoting said back rest and leg rest to inclined positions of adjustment, said flat base being of rigid construction and supporting the remaining portion of the bed in super-imposed position in order that said flat base may rest on a flat support, said leg rest being comprised of upper and lower leg rest members pivotally connected together and said lower leg rest member having means connecting it to roller elements by axle means and motor means provided for moving said axle means longitudinally of said base to raise and lower said back rest and a lower end of said lower leg rest being directly connected to said roller elements.

2. The bed of claim 1, in which rotary worm gear means are connected to each of said motor means and a threaded block means receives said worm gear means and is connected to each of said axle means whereby the rotary movement of said worm gear means causes said axle means and roller elements to move longitudinally with respect to said bed.

3. A portable orthopedic bed comprising a flat base, a frame-like back rest, an intermediate body rest and a leg rest, said back rest being pivotably supported at one end above said base toward said body rest and said leg rest being pivotably supported at one end toward said body rest, said aforementioned rests being supported upon said flat base for pivoting said back rest and leg rest to inclined positions of adjustment, said flat base being of rigid construction and supporting the remaining portion of the bed in super-imposed position in order that said flat base may rest on a flat support, said leg rest being comprised of upper and lower leg rest members pivotally connected together and said lower leg rest member having means connecting it to roller elements by axle means and motor means provided for moving said axle means longitudinally of said base to raise and lower said back rest, said lower leg rest member being pivotally connected by a link member to a fixed pivot means on said base and a power link pivotally connected to said axle means at one end and additionally pivoted to said link member at an intermediate portion thereof.

4. The bed of claim 3, in which said power link has a free end adapted to bear against the underside of said upper leg rest to assist in the raising and lowering thereof.

5. The bed of claim 4, in which the free end of said power link is moved out of contact with said upper leg rest as said power link is moved toward a vertical thrust relation with said link member.

* * * * *